US006388693B1

(12) United States Patent
Loos

(10) Patent No.: US 6,388,693 B1
(45) Date of Patent: May 14, 2002

(54) APPARATUS FOR PRINTING GRAPHIC IMAGES ON SHEET MATERIAL HAVING AN INK WEB CASSETTE WITH CONSTANT WEB TENSION

(75) Inventor: William Loos, Broad Brook, CT (US)

(73) Assignee: Gerber Scientific Products, Inc., Manchester, CT (US)

( * ) Notice: Subject to any disclaimer, the term of this patent is extended or adjusted under 35 U.S.C. 154(b) by 955 days.

(21) Appl. No.: 09/127,347

(22) Filed: Jul. 31, 1998

Related U.S. Application Data

(62) Division of application No. 08/559,724, filed on Nov. 15, 1995, now Pat. No. 5,808,654.

(51) Int. Cl.[7] ..... B41J 32/00
(52) U.S. Cl. ..... 347/214
(58) Field of Search ..... 347/214; 400/207, 400/208, 208.1

(56) References Cited

U.S. PATENT DOCUMENTS

| | | | | |
|---|---|---|---|---|
| 948,207 | A | 2/1910 | Coon | |
| 2,805,828 | A | 9/1957 | Bachman | 242/63 |
| 4,445,128 | A | 4/1984 | Dolan et al. | 347/130 |
| 4,948,282 | A | 8/1990 | Koike et al. | 400/616.2 |
| 5,267,401 | A | 12/1993 | Freeman et al. | 33/733 |

FOREIGN PATENT DOCUMENTS

| | | |
|---|---|---|
| EP | 0472471 | 2/1992 |
| EP | 0607539 | 7/1994 |
| EP | 0672529 | 9/1995 |
| JP | 57-46896 | 3/1982 |
| JP | 62103171 | 5/1987 |
| JP | 63-218459 | 9/1988 |
| JP | 02069276 | 3/1990 |
| JP | 03261578 | 11/1991 |

OTHER PUBLICATIONS

European Search Report from corresponding European Appln. No. 96117095.8.

*Primary Examiner*—Huan Tran
(74) *Attorney, Agent, or Firm*—McCormick, Paulding & Huber LLP

(57) ABSTRACT

An apparatus for printing graphic images on sheet material has a thermal print head with a linear array of heating elements pressed into engagement with an ink web overlying the sheet material on a platen. The platen extends in the lengthwise direction of the print head across the width of the sheet material, and is rotatably driven to in turn drive the sheet material with the ink web relative to the print head. A removable cassette having a predetermined length of ink web bearing a printing ink is mounted adjacent to the print head with the ink web interposed between the sheet material and the print head for printing the graphic images on the sheet. A supply spool carrying the ink web is rotatably mounted in the cassette, and a take-up spool is also rotatably mounted in the cassette for receiving the ink web from the supply spool upon passage between the platen and print head. The take-up spool defines a first overall diameter without receiving the ink web from the supply spool, and a greater second overall diameter upon receiving the predetermined length of ink web, wherein the second overall diameter is no more than 10% greater than the first overall diameter. A spring-wrapped clutch is drivingly connected between a take-up motor and the take-up spool to impart a constant torque to the take-up spool for winding the ink web onto the spool during printing operations and to thereby maintain a substantially constant tension within the ink web.

1 Claim, 4 Drawing Sheets

APPARATUS FOR PRINTING GRAPHIC IMAGES ON SHEET MATERIAL HAVING AN INK WEB CASSETTE WITH CONSTANT WEB TENSION

CROSS REFERENCE TO RELATED APPLICATION

This application is a divisional application divided from prior application Ser. No. 08/559,724 filed Nov. 15, 1995 now U.S. Pat. No. 5,808,654.

FIELD OF THE INVENTION

The present invention relates to apparatus for making graphic products on sheet material, and more particularly, to such an apparatus having a replaceable cassette carrying an ink web bearing printing ink, and a take-up motor for driving the ink web with the sheet material between a platen and a print head for printing graphic images on the sheet material.

BACKGROUND OF THE INFORMATION

There are several commercially-available systems today that employ thermal print heads to transfer ink from an ink web to a strip of sheet material to produce graphic products with multicolored or enhanced graphic images for signs and like displays. One such commercially-successful system is manufactured and sold by Gerber Scientific Products, Inc. of Manchester, Conn. under the trademark GERBER EDGES. The GERBER EDGE™ is typically used to print graphics for signs or like displays, wherein multicolored or enhanced graphic images are typically printed on a vinyl or like polymeric sheet, and the sheet is cut along the periphery of the graphic images to create a sign or like display. The system uses a thermal print head to print the graphic images on the sheet, and a cutter to cut the sheet along a peripheral edge surrounding the graphic images. The print head and the cutter are controlled by a microprocessor having a common data base so that the printed images and the cut edges correspond positionally in the final graphic product.

A roller platen carrying the sheet material is mounted below the print head, and a removable cassette carrying a donor web bearing transfer ink is mounted adjacent to the print head so that the donor web is interposed between the print head and the sheet material. The print head presses the donor web against the sheet material and the heating elements of the print head are selectively energized to transfer ink from the web to the sheet in accordance with commands from the microprocessor to create graphic images on the sheet. Each cassette carries a donor web bearing a single color of transfer ink, and the cassettes are interchanged to create multicolored images, different shades and/or colors. The roller platen and sheet material are slewed back and forth during printing operations to apply the different color inks.

The GERBER EDGE™ system described above is disclosed in U.S. Pat. No. 5,537,135, entitled "Method And Apparatus For Making A Graphic Product", which is assigned to the Assignee of the present invention, and is hereby expressly incorporated by reference as part of the present disclosure.

A typical ink web used in such systems is comprised of a resin and/or wax layer containing the transfer ink, a release layer superimposed over the resin/wax layer, a carrier layer superimposed over the release layer, and a back coat superimposed over the carrier layer to provide a low-friction surface for engaging the print head. When the heating elements of the thermal print head are energized, the portions of the resin layer contiguous to the print head undergo transformation from (i) a solid state, to (ii) a semifluid or viscous state, and at the highest temperatures, to (iii) a less viscous, liquid state. Then, as the heating elements are de-energized and upon passage of the ink web and sheet material beyond the print head, the heated portions cool down and return from the liquid, semifluid or viscous states to the solid state, as they approach ambient temperature.

During these changes in physical states, the coefficients of friction and thus the forces transmitted between the sheet material, ink web and print head vary, which leads to variations in the surface velocity of the sheet material, and can in turn cause sagging or like deformation in the sheet as it passes beneath the print head. Typically, the longer the print head (i.e., the dimension of the print head in the axial direction of the platen), the greater are the variations in the forces applied to the sheet material. Because the vinyl and like polymeric sheets are flexible, the increase in the forces transmitted between the sheet and print head on each cool-down cycle can cause a lag or positional error between the portions of the sheet contiguous to the print head and other areas, such as the marginal portions of the sheet engaging the sprockets. These variations in the sheet material velocity and positional errors lead to fluctuations in image intensity and, concomitantly, a degradation in print quality.

In a typical commercially-available system the cassette has a supply spool carrying the ink web and a take-up spool for receiving the ink web upon passage beneath the print head. A take-up motor is coupled through an electromagnetic slip clutch to the take-up spool to tension and wind the ink web onto the take-up spool and to assist in driving the sheet material engaged with the ink web beneath the print head. It is perceived as desirable to provide as much ink web as possible in a cassette in order to increase the cassette's operational life and thereby reduce the frequency at which the cassettes must be replaced. As a result, however, the transfer of ink web from the supply spool to the take-up spool typically causes a significant change in the overall diameter of the take-up spool from the time a cassette is first installed to the time a cassette is near depletion, sometimes on the order of at least about 20 to 25%. Because the tension applied to the ink web is a function of the overall diameter of the take-up spool with web, there is a corresponding change in the tension applied to the ink web as it is wound onto the take-up spool.

Accordingly, the ink web tension may substantially vary from the time a relatively long printing operation is initiated to the time it is completed, or when cassettes at different stages of use are interchanged to apply different colors during printing operations or to replace a depleted cassette. In addition, the electromagnetic clutches used in current systems have a tendency to wear down during the operational life of a system and thereby fail to impart a constant torque to the take-up spool during printing operations, further compounding the variations in, and lack of control over ink web tension. These variations in web tension create corresponding variations in the sheet material and ink web velocity, which in turn lead to further errors in the registration of the print head with the sheet material and compound any degradation in print quality as described above.

It is an object of the present invention to overcome the drawbacks and disadvantages associated with such variations in ink web tension in apparatus for printing graphic images on sheet material.

SUMMARY OF THE INVENTION

The present invention is directed to an apparatus for printing graphic images on sheet material comprising a print head, such as a thermal print head having a linear array of heating elements, which is pressed into engagement with an ink web overlying the sheet material on a platen. The platen may be, for example, a roller platen which is rotatably driven to in turn drive the sheet material with the ink web relative to the print head. A removable cassette having a predetermined length L of ink web bearing a printing ink is mounted adjacent to the print head with the ink web interposed between the sheet material and the print head for printing the graphic images on the sheet. A supply spool carrying the ink web is rotatably mounted within the cassette, and a take-up spool is also rotatably mounted within the cassette for receiving the ink web from the supply spool upon passage between the platen and print head. The take-up spool defines a first overall diameter D1 without receiving the ink web from the supply spool, and a greater second overall diameter D2 upon receiving the predetermined length L of ink web, wherein the second overall diameter D2 is within approximately 10% of the first overall diameter D1. The apparatus further comprises means for applying a constant torque to the take-up spool, preferably a spring-wrapped clutch, to thereby maintain a substantially constant tension within the ink web during printing operations.

One advantage of the apparatus of the present invention is that the first overall diameter D1 of the take-up spool and the predetermined length L of the ink web in the cassette are selected so that the overall diameter of the take-up spool cannot vary by more than 10% upon receiving the ink web. This, in combination with the constant-torque clutch, preferably a spring-wrapped clutch, maintains a substantially constant tension within the ink web during printing operations throughout the operational life of the apparatus, and thereby maintains precise registration between the print head and the sheet material in order to accurately print high-quality graphic images. As also described in detail below, the apparatus of the invention preferably employs a platen drive for transmitting a substantially constant force per unit width, to the sheet material to drive the sheet material and ink web at a substantially constant velocity across their width, along with encoded sprockets or like registration means engaging the marginal portions of the sheet material to thereby further facilitate precise registration of the sheet material with the print head.

Other objects and advantages of the present invention will become apparent in view of the following detailed description and accompanying drawings.

DETAILED DESCRIPTION OF PREFERRED EMBODIMENT

Figure 1:
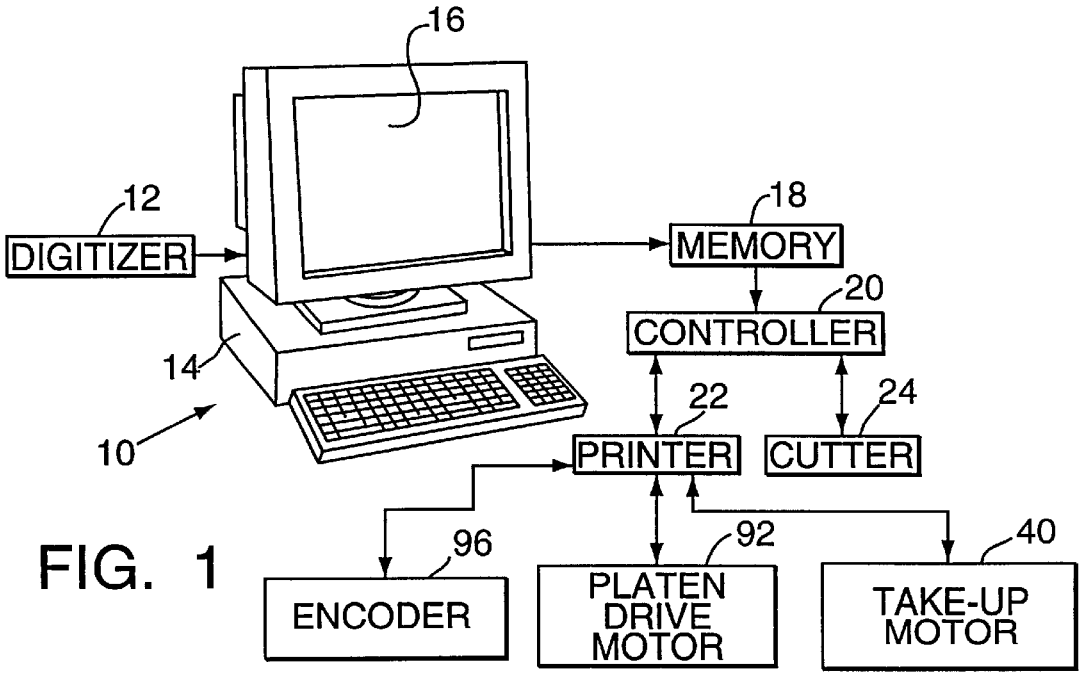
FIG. 1 is a schematic diagram illustrating a system embodying the sent invention for printing and cutting graphic images on sheet material.

In FIG. 1, an apparatus embodying the present invention for making graphic products with multicolored and/or enhanced graphic images is indicated generally by the reference numeral 10. The apparatus 10 includes a digitizer 12 or other data input device which transmits data to a computer 14 defining at least,the peripheral edges of the graphic product and possibly internal edges as well. The computer 14 displays the data defining the edges as an image on a monitor 16. Then, printing enhancements from a special enhancement program within the computer's memory 18 for creating and printing graphic images are added within the edges of the displayed image as the operator or composer desires by employing a keyboard, mouse and/or like input device.

From the image data defining an enhanced graphic product, the computer 14 generates at least one printing program for operating a controller 20 to control a printing apparatus 22 to print the prepared graphic images on a sheet material. If desired, the computer may also generate a cutting program for operating the controller 20 to control a cutting apparatus 24 to cut the sheet material around the graphic images and create the final graphic product.

In a preferred embodiment of the present invention, the sheet material is a vinyl secured by a pressure-sensitive adhesive on a releasable backing. One such vinyl is sold by the Assignee of this invention under the trademark SCOTCHCAL™ of the 3M Company. As will be recognized by those skilled in the pertinent art, however, numerous other types of sheet material may equally be employed, such as paper and other types of polymeric sheets, including polyvinyl chloride (PVC) and polycarbonate sheets. Similarly, the sheet material may be supplied in any length on rolls, in flat sheets, or as otherwise desired.

Figure 2:
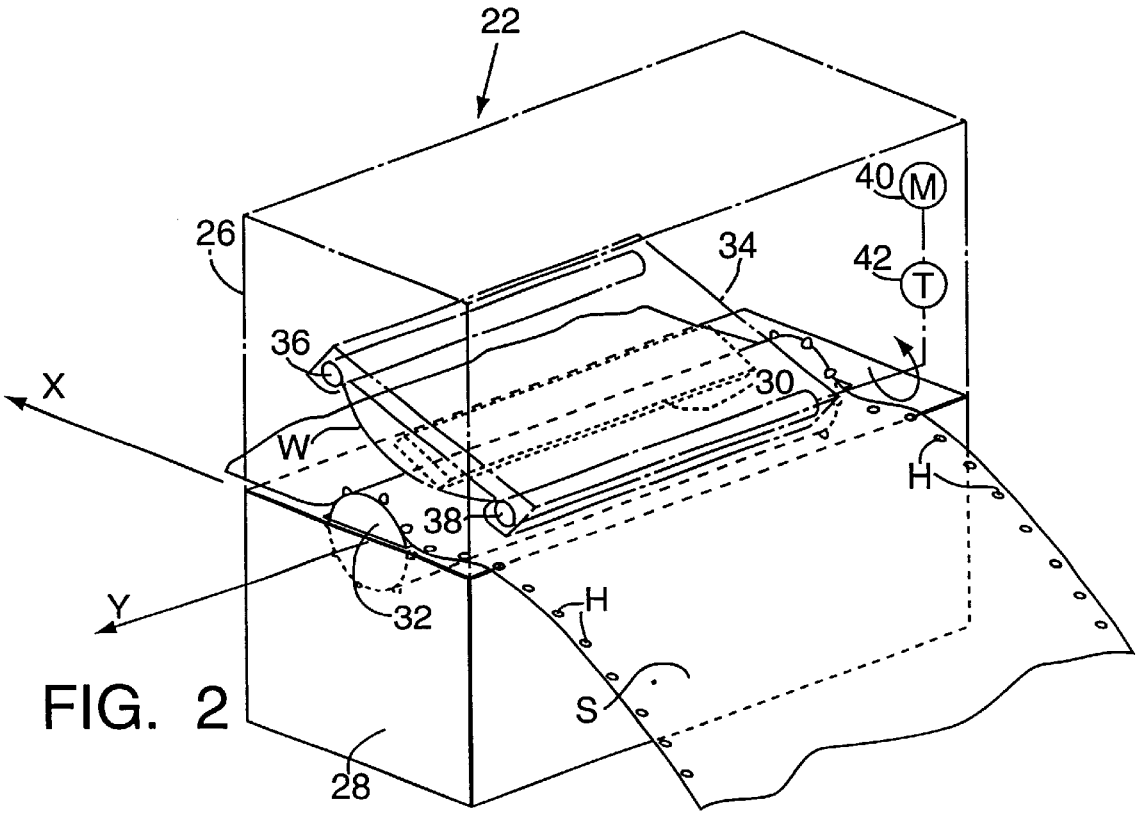
FIG. 2 is a somewhat schematic diagram of the printing apparatus of the system of FIG. 1.

With reference to FIG. 2, the printing apparatus 22 includes a cover assembly 26 (shown in broken lines) pivotally mounted to a base assembly 28 for opening and closing the cover to access the internal structure of the printer. A thermal print head 30 (shown in broken lines) is mounted on a frame under the cover 26, and a roller platen 32 is rotatably mounted in the base assembly 28 below the print head for supporting and driving the sheet material S through the printer. A replaceable cassette 34 (also shown in broken lines in FIG. 2) is installed under the cover 26, and carries a predetermined length L of ink web W bearing the printing ink, which is interposed between the print head 30 and the sheet material S on the roller platen 32. A supply spool 36 carrying the unused ink web W is rotatably mounted in the cassette, and a take-up spool 38 is also rotatably mounted in the cassette for receiving the ink web from the supply spool upon passage between the platen 32 and print head 30.

The thermal print head 30 extends in the axial direction of the roller platen, and is pressed downwardly onto the ink web W and sheet material S to establish a linear zone of contact between the ink web, sheet material and roller platen. The print head 30 includes a plurality of heating elements distributed evenly along the head from one end to the other, and the heating elements are selectively energized so that the portion of the ink immediately beneath each energized heating element is released from the web and transferred to the sheet material. The excitation of the heating elements is controlled in accordance with the program of printed material that is read by the controller 20 from the memory 18 of FIG. 1.

As shown schematically in FIG. 2, a take-up motor 40 is connected through a constant-torque clutch 42 to the take-up spool 38 of the cassette 34 for rotatably driving the take-up spool during printing operations, as indicated by the arrow in FIG. 2, and in turn winding the ink web W from the supply spool onto the take-up spool. The constant-torque clutch 42 is preferably a spring-wrapped clutch, which will typically regulate the torque applied to the take-up spool 38 within a tolerance range of about 1%, and will therefore apply a constant torque to the take-up spool throughout the operational life of the apparatus.

Figure 3:
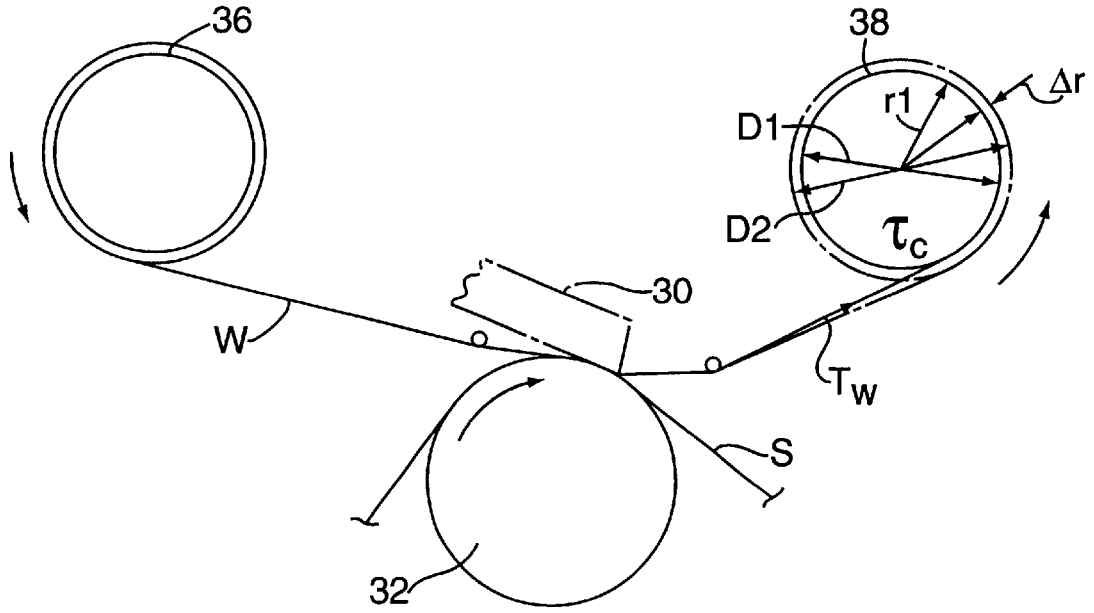
FIG. 3 is a schematic diagram illustrating the take-up and supply spools of the ink web cassette and the passage of the ink web between the print head and sheet material on the roller platen in the printing apparatus of FIG. 2.

With reference to FIG. 3 and in accordance with the present invention, the take-up spool 38 defines a first or core diameter D1 without receiving any ink web W, and a second overall diameter D2 upon receiving the entire length L of ink web W from the supply spool, wherein the second diameter D2 is within approximately 10% of the first diameter D1. The tension $T_w$ in the ink web w is defined as follows:

$$T_w=t_c/(r1+\Delta r)=t_c/[(D1+\Delta D)/2)]$$

wherein, $t_c$ the torque applied by the spring-wrapped clutch 42 to the take-up spool 38, r1 and D1 are the first radius and first diameter of the take-up spool 38, respectively, (i.e., the core radius and diameter without receiving any ink web), and Δr and ΔD are the change in the overall radius and diameter, respectively, of the take-up spool 38 upon receiving the ink web W from the supply spool. Thus, if $\Delta D<<D_1$, then $T_w \sim t_c/(D1/2)=K$, an approximately constant ink web tension value.

Accordingly, because the total length L of the ink web W in the cassette and the core diameter D1 of the take-up spool are selected so that D2 is no more than 10% greater than D1, and the spring-wrapped clutch 42 applies a constant torque $t_c$ to the take-up spool, a substantially constant ink web tension $T_w$ is maintained throughout each printing operation. In an exemplary embodiment of the invention, the core diameter D1 of the take-up spool 38 is approximately 1.80 inches, the thickness of the ink web W is approximately 0.00033 inch, and the length L of ink web W in the cassette is approximately 1800 inches. As will be recognized by those skilled in the pertinent art, these dimensions are exemplary, and may be changed as necessary to meet the requirements of a particular system. However, the predetermined length L of the ink web w is preferably at least approximately 900 inches (or 25 yards), and for the ink web described herein, the core diameter D1 of the take-up spool is at least approximately 1.50 inches. For thicker ink webs, however, the core diameter D1 of the take-up spool will have to be increased for the same predetermined length L of web to minimize the change in overall take-up spool diameter during printing operations.

The cassette 34 is preferably replaceably mounted in the printing apparatus 22 in the same manner as disclosed in the patent incorporated by reference above. Accordingly, the cassette 34 is held in an operative position within a support frame of the apparatus, as described in further detail below, and is easily installed and removed from the frame when the cover 28 is lifted to an open position.

Figure 4:
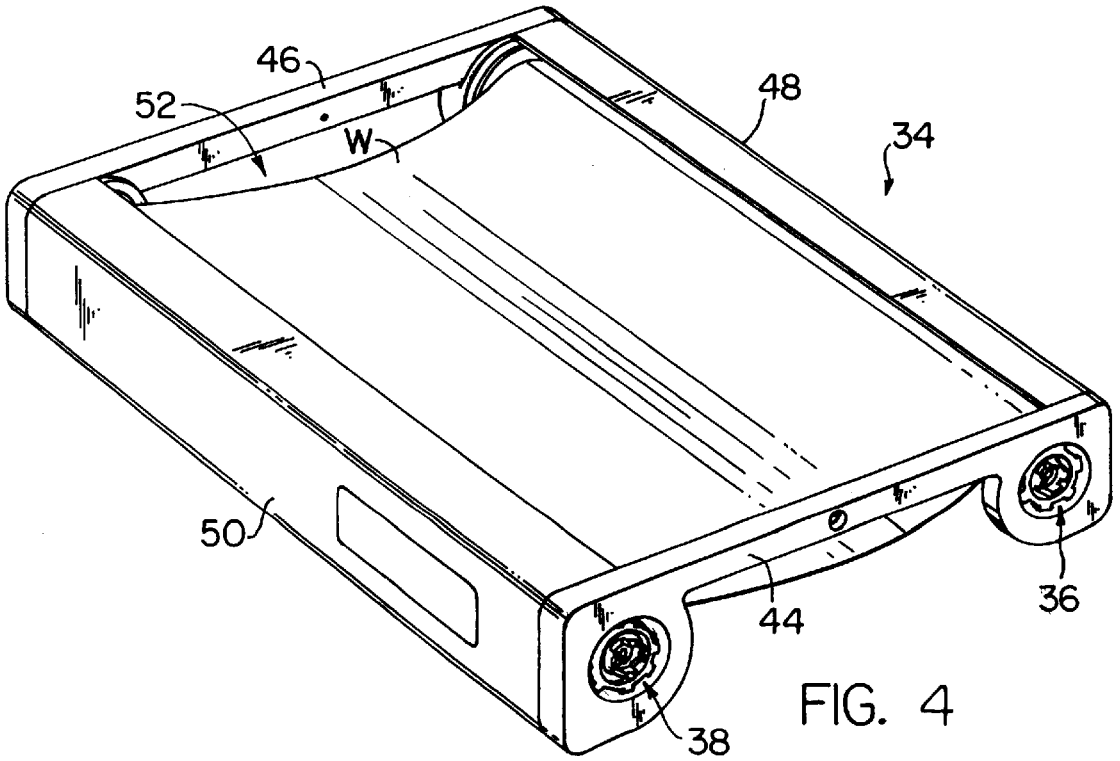
FIG. 4 is a perspective view of the ink web cassette of FIG. 2.

A typical cassette 34 is illustrated by itself in FIG. 4, and includes two molded side rails 44,46 and two end shells 48,50 forming a generally rectangular configuration defining a central opening 52 through which the print head 30 is received to press the ink web W against the sheet material S supported on the roller platen 32, as shown in broken lines in FIG. 2. One end of the ink web W is connected to the supply spool 36 enclosed within the end shell 48 and the other end is connected to the take-up spool 38 enclosed within the end shell 50. The supply spool 36 is supported loosely within a pair of aligned holes formed in one end of each of the side rails 44,46, and the take-up spool 38 is likewise supported loosely within a pair of aligned holes formed in the other end of each side rail.

Figure 5A:
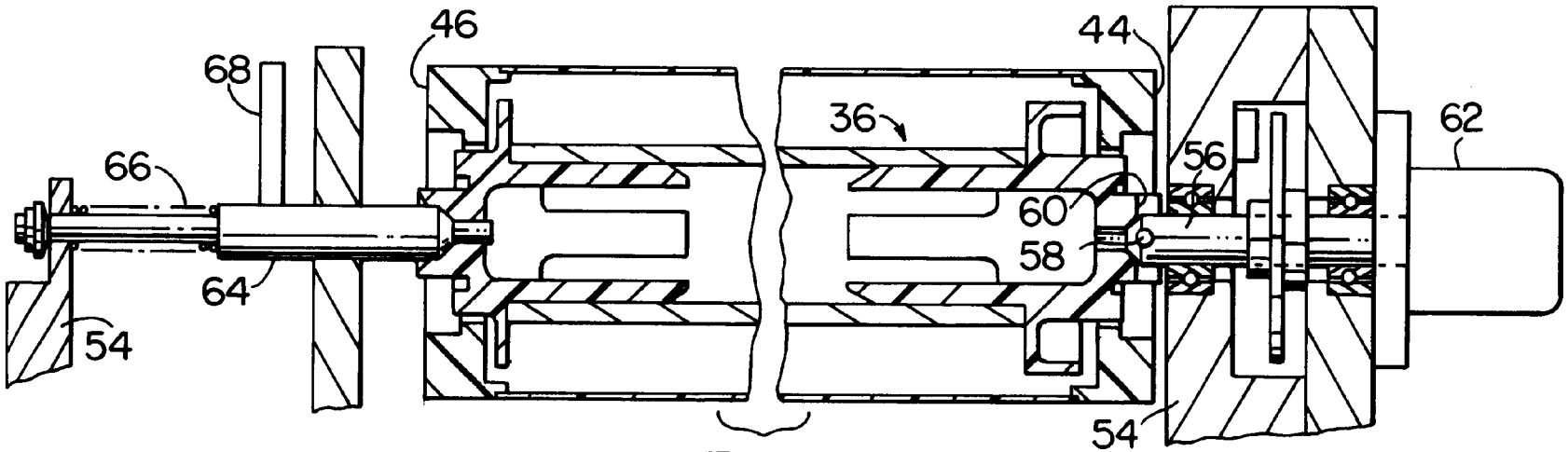
FIGS. 5A, 5B and 5C are fragmentary views showing the support structure for the cassette and its take-up and supply spools, along with the spring-wrapped clutch and take-up motor for winding the ink web onto the take-up spool and maintaining a constant ink web tension when the cassette in mounted in the printing apparatus of FIG. 2.
Figure 5B:
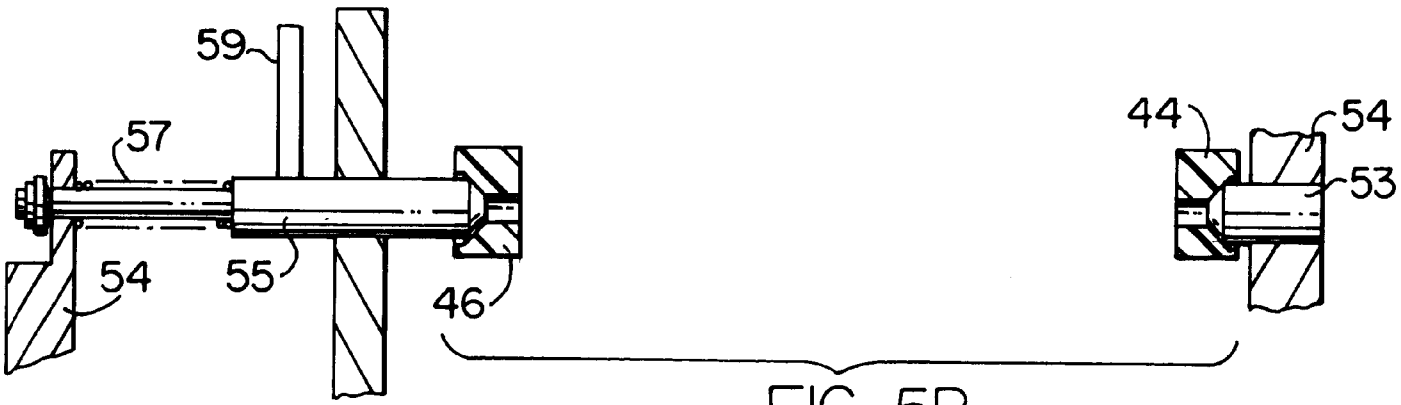

With reference to FIG. 5B, the cassette 34 is mounted in a support frame 54 of the apparatus by a mounting pin 53 received within a corresponding alignment aperture formed in the side rail 44, and a retracting axle 55 engages a corresponding alignment aperture formed in the side rail 46. The axle 55 is biased inwardly by a compression spring 57 to force the mounting pin and axle into the respective alignment apertures, and thereby hold the cassette in an operative position within the support frame. The retracting axle 55 is connected to a lever 59 for retracting the axle against the spring, and in turn releasing the cassette from the support frame.

As shown in FIG. 5A, when the cassette 34 is mounted in the support frame 54, one axial end of the supply spool 36 is mounted on a rotatable axle 56, which centers the spool within the respective mounting hole of the cassette and is coupled to the axle by means of a cross pin 58 received within slots 60 of the spool. The end of the axle 56 opposite the cross pin is coupled to a slip clutch or drag brake 62 which imposes frictional restraint on the supply spool as the ink web W is pulled off of the spool. The opposite end of the supply spool 36 is mounted on an axle 64, which is biased inwardly by a compression spring 66 and connected to a lever 68 for retracting the axle and in turn releasing the spool from the frame.

Figure 5C:
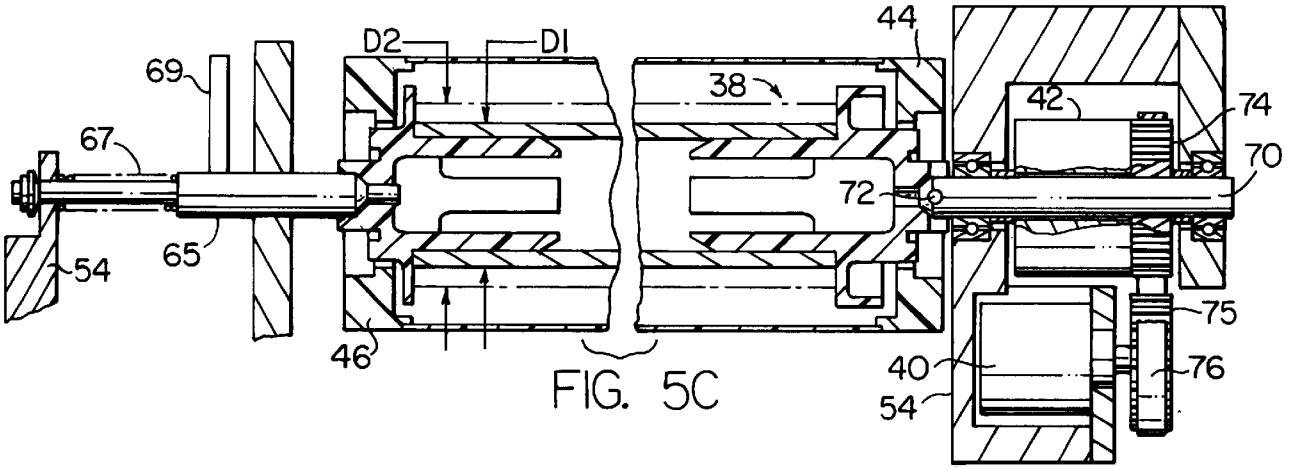

Similarly, as shown in FIG. 5C, one end of the take-up spool 38 is mounted on an axle 65 biased inwardly by a compression spring 67 and connected to a release lever 69. The other end of the take-up spool is mounted on a rotatable axle 70 which centers the spool and is drivingly engaged with the axle by a cross pin 72. The axle 70 is also drivingly connected to the output of the spring-wrapped clutch 42, and the input of the clutch is drivingly connected to the take-up moor 40 by a toothed pulley 74, a toothed pulley 75 connected to the output shaft of the take-up motor, and a toothed drive belt 76 connected to both pulleys. Accordingly, the spring-wrapped clutch 42 imparts a constant torque to the take-up spool 38 when the take-up motor 40 is energized. As shown in FIG. 1, the take-up motor 40 is coupled to the controller 20 to actuate the motor during printing in accordance with the printing program generated by the computer 14.

Because the overall diameter D2 of the take-up spool upon receiving the entire length L of ink web W, as shown in broken lines in FIG. 5C, is no more than 10% greater than the core diameter D1, the system of the present invention maintains the ink web W at a substantially constant tension Tw. As a result, the sheet material with ink web may be driven at a substantially constant velocity across the width of the sheet and web, as is described further below, to thereby maintain precise registration between the print head and sheet material and print graphic images of high resolution and quality.

In order to facilitate such precise registration between the sheet material S and print head 30, the printing apparatus 22 may drive and track the sheet material and sprockets as disclosed in the above-mentioned patent, but preferably employs a platen drive to move the sheet material S relative to the print head in combination with encoded sprockets and/or an encoded sprocket shaft, as described, for example, in co-pending U.S. patent application Ser. No. 08/440,083, filed May 12, 1995, entitled "Apparatus For Making Graphic Products Having A Platen Drive With Encoded Sprockets", which is assigned to the Assignee of the present invention, and is hereby expressly incorporated by reference as part of the present disclosure.

Figure 6:
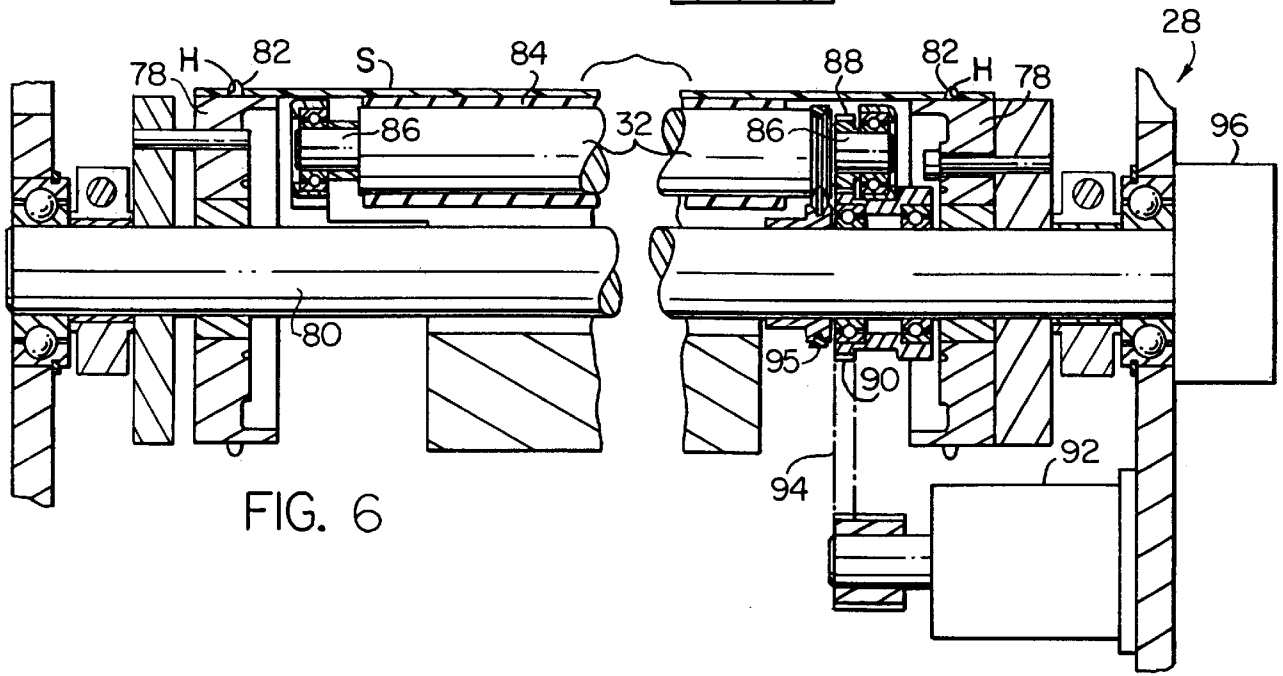
FIG. 6 a fragmentary front view, in partial cross section showing the platen drive with encoded sprocket shaft of the printing apparatus of FIG. 2.

As shown in FIG. 6, a set of sprockets 78 are rotatably mounted to the base assembly 28 on a common sprocket shaft 80, and each sprocket includes a plurality of sprocket pins 82 which engage corresponding feed holes H formed along each longitudinal edge of the sheet material S to guide and steer the sheet, and maintain precise registration of the sheet with the print head as it is driven by the roller platen beneath the print head. The roller platen 32 includes a rubber sleeve 84 for engaging and driving the sheet material S. The polymeric material of the sleeve 84 is selected to provide a firm surface to support the sheet material S beneath the print head, and to enhance the frictional engagement of the platen with the backing of the strip to effectively drive the strip.

Each registration sprocket 78 is fixed to the shaft 80 in its rotational direction so that the sprockets rotate in sync with each other and the shaft; however, at least one of the sprockets may be slidably mounted in the axial direction of the shaft to permit lateral adjustment of the sprockets to accommodate sheet materials of different width. The roller platen 32 is spaced adjacent and oriented parallel to the sprocket shaft 80, and is mounted on a drive shaft 86 rotatably mounted to the base assembly 28. A platen drive gear 88 is fixedly mounted to the platen drive shaft 86, and is meshed with an idler gear 90 rotatably mounted to the sprocket shaft 80. A platen drive motor 92, which may be, for example, a step motor, is mounted to the base assembly 28, and is coupled through a suitable gear train 94, as shown in broken lines in FIG. 6, to the idler gear 90. Actuation of the platen drive motor rotatably drives the idler gear 90, and in turn directly drives the platen drive gear 88 and roller platen 32. As will be recognized by those skilled in the pertinent art, other suitable means may be employed to drivingly connect the platen drive motor to the roller platen, such as a drive belt.

Accordingly, the sheet material S and ink web W are pressed against the roller platen 32 by the print head 30 along substantially the entire length of the print head, and the sheet material is further maintained in conforming engagement with the roller platen by bail assemblies (not shown) mounted over each registration sprocket to directly drive the sheet with ink web by the platen drive motor and roller platen. The registration sprockets 78, engage the feed holes H to guide and steer the sheet material, and in turn prevent skewing of the sheet material under the driving force of the platen, and maintain precise registration of the sheet with the print head.

As also shown in FIG. 6, a drive belt 95 may be connected between the platen shaft 86 and sprocket shaft 80 to drive the sprockets and in turn move the sheet material S when the print head is lifted during non-printing operations. The belt 95 is designed to allow limited slip so that it does not drive the sprockets, or otherwise cause distortion of the feed holes H during printing operations. Alternatively, a separate drive motor (not shown) may be connected to the sprocket shaft to drive the sprockets and sheet material during non-printing operations.

As also described in the above-mentioned co-pending patent application and shown in FIG. 6, a positional sensor 96 is preferably mounted adjacent to the sprocket shaft 80 to track with the controller 20 the rotational position of the registration sprockets 78 and thus the position of the sheet material S engaged by the sprockets. As shown in FIG. 1, the positional sensor or encoder 96 is also coupled to the controller 20 and transmits signals to a register in the controller indicative of the rotational direction and position of the sprocket shaft 80, and thus of the rotational direction and position of the registration sprockets 78 mounted to the shaft. As will be recognized by those skilled in the pertinent art, any of numerous known types of sensors may be employed, including, for example, a suitable resolver or encoder, such as an optical encoder, for encoding the registration sprockets or sprocket shaft and generating signals indicative of their rotational direction and position.

Accordingly, the controller 20 tracks the rotational position of the sprockets and selectively energizes the heating elements of the print head in accordance with the printing program, and in the preferred embodiment the controller tracks the rotational position of the sprockets based on the positional signals transmitted by the sensor 96 coupled with the image data. Because the ink web W is maintained at a substantially constant tension $T_w$ as it is wound onto the take-up spool, and the roller platen drives the sheet material at a substantially constant velocity across its width, the sheet material and ink web are uniformly driven between the roller platen and print head, thus permitting the feed holes H to maintain precise registration of the sheet material with the print head. The positional signals transmitted by the sensor 96 are therefore indicative of the precise position of the sheet material relative to the print head, thus permitting the graphic images to be accurately printed on the sheet material in accordance with the printing program.

As will be recognized by those skilled in the pertinent art, numerous changes and modifications may be made to the above-described and other embodiments of the present invention without departing from its scope as defined in the appended claims. Accordingly, the detailed description of the preferred embodiment herein is to be taken in an illustrative as opposed to a limiting sense.

What is claimed is:

1. A cassette for a thermal-transfer printing apparatus having a strip of sheet material for receiving the graphic images, wherein the sheet material defines a plurality of feed holes spaced relative to each other in opposed marginal portions thereof; a platen mounted adjacent to the sheet material for supporting the sheet material; a print head movable into engagement with an ink web of the cassette and sheet material along a line of contact extending in a lateral direction of the sheet for transferring printing ink from the ink web onto the sheet and printing the graphic images on the sheet; a take-up motor for driving the ink web of the cassette; a substantially constant-torque clutch drivingly connected to the take-up motor for generating a substantially constant motor torque; two sprockets rotatably mounted on opposite ends of the platen relative to each other, and engaging the feed holes of the sheet material upon passage between the platen and print head; a drive motor drivingly connected to at least one of the platen and sprockets for rotatably driving at least one of the platen and sprockets and moving the sheet material engaged by the platen and sprockets; and a controller electrically coupled to the drive motor and print head, wherein the controller tracks the rotational position of at least one sprocket to register the print head with the sheet material, and actuates the print head based on the rotational position of the at least one sprocket for printing the graphic images on the sheet material; wherein the cassette comprises:

a predetermined length of ink web; a supply spool mounted within the cassette and carrying the ink web, wherein the supply spool is releasably connectable to the thermal-transfer printing apparatus with the ink web interposed between the sheet material and print head for transferring printing ink from the ink web onto the sheet and printing the graphic images on the sheet; a take-up spool mounted within the cassette and connected to the ink web for receiving the ink web from the supply spool, wherein the take-up spool is drivingly connectable to the constant-torque clutch for rotatably driving the take-up spool at a constant torque and winding the ink web thereon during printing operations, and wherein the take-up spool defines a predetermined, first overall diameter without receiving the ink web and a greater second overall diameter upon receiving the predetermined length of ink web, the predetermined length of the ink web and the predetermined first overall diameter of the take-up spool having values such that the second overall diameter is within approximately 10% of the first overall diameter for maintaining a substantially constant tension within the ink web, and in conjunction with the sprockets and controller thereby maintaining registration between the print head and sheet material during printing operations.

* * * * *